United States Patent [19]

von Lange et al.

[11] Patent Number: 5,046,907

[45] Date of Patent: Sep. 10, 1991

[54] ONE-PIECE ELASTIC RAIL MOUNTING CLIP

[75] Inventors: Hans J. von Lange, Stewartstown, Pa.; Oswald Lochschmidt, Bergisch-Gladbach, Fed. Rep. of Germany

[73] Assignee: Hans J. Von Lange, Stewartson, Pa.

[21] Appl. No.: 512,918

[22] Filed: Apr. 23, 1990

[51] Int. Cl.[5] ..... F16B 15/06; E01B 9/00; E01B 13/00

[52] U.S. Cl. ..... 411/456; 411/473; 411/483; 238/349; 238/366

[58] Field of Search ..... 238/349, 366–370, 238/375, 376; 411/450, 452, 456, 483, 485, 923, 473

[56] References Cited

U.S. PATENT DOCUMENTS

| | | | |
|---|---|---|---|
| 2,194,590 | 3/1940 | Dawson | 238/366 |
| 2,257,640 | 9/1941 | Muller | 238/366 |
| 2,290,993 | 7/1942 | Preston | 238/366 |
| 2,450,559 | 10/1948 | Parsons | 238/349 |
| 2,780,416 | 2/1957 | Hodel | 238/366 |
| 2,890,833 | 6/1959 | Wirsing | 238/366 |
| 4,339,077 | 7/1982 | Dahlhaus et al. | 238/349 |
| 4,714,195 | 12/1987 | Creutz et al. | 238/366 |

*Primary Examiner*—Neill R. Wilson

*Attorney, Agent, or Firm*—Cushman, Darby & Cushman

[57] ABSTRACT

A one-piece single- or double-shank spring clip, which is used for elastic rail mounting for positively and elastically anchoring a rail relative to a tie plate without using any screws, said tie plate including fastening holes and the spring clip being adapted to be brought into engagement with said fastening holes in the area of its shank, consists of a bent steel rod, which is provided with one or with two spring loop(s) holding down the rail foot. The spring clip has one or two shanks, which are followed by one or two spring loops for holding down the rail foot, the shank being defined by a steel rod member bent by 180° and having, at its lower end in the area of the 180°-bend, one or several projection(s) adapted to engage the tie plate underside, which faces away from the rail, in the area of the fastening hole (FIG. 2).

36 Claims, 15 Drawing Sheets

A-B

ONE-PIECE ELASTIC RAIL MOUNTING CLIPDESCRIPTION

The present invention refers to a one-piece spring clip with a single or double shank for elastic rail mounting for positively and elastically anchoring a rail relative to a tie plate without using any screws, said tie plate including fastening holes and the spring clip being adapted to be brought into engagement with said fastening holes in the area of its shank or of its shanks, said spring clip consisting of a bent steel rod, preferably a rectangular steel rod, and having one or two spring loops which hold down the rail.

BACKGROUND OF THE INVENTION

German-pat. 29 11 825 already discloses a spring clip for elastic mounting of a rail relative to a concrete tie. The known one-piece spring clip for elastic rail mounting serves to positively and elastically anchor the rail relative to a concrete tie without using any screws, said concrete tie including fastening holes for this purpose and the spring clip being adapted to be brought into engagement with said fastening holes in the area of its shank. The known spring clip consists of a bent steel rod and is provided with a spring loop holding down the rail in the area of the rail foot. For anchoring the known spring clip, a claw is required at the lower end of the shank of said spring clip, said claw engaging positively behind a spherical holding surface. A holding surface of this type is not provided in the case of a conventional tie plate, such as the so-called "USA plate No. 8" for lumber ties. Hence, the known spherical clip is disadvantageous insofar as it can only be used in combination with spherical holding surfaces, whereas it cannot be used in the case of conventional tie plates, especially on lumber ties.

U.S. Pat. No. 4349151 reveals an elastic fastening arrangement, which consists of two separate components and which includes a bow-shaped component as well as a spring for holding down the rail foot, said spring being in engagement with the bow-shaped component, which is, in turn, in engagement with the underside of a base part or of a tie plate. The known fastening arrangement for rails includes a noselike projection, which is provided on the bow and which engages the underside of the tie plate in the area of the associated fastening hole. However, multipart fastening arrangements are not only comparatively complicated to produce but they also require comparatively complicated work when the rail fastening means are mounted.

U.S. Pat. No. 2 387 009 discloses an elastic fastening arrangement for fastening a rail relative to a base part or a tie plate. The known fastening arrangement comprises a screw body having at the lower end thereof a noselike projection, which engages the underside of the base part in the area of a fastening hole through which the screw body extends. The upper side of the screw body is provided with a nut, which is adapted to be used for pressing down a spring plate resting on the tie plate on the one hand and on the rail foot on the other for guaranteeing thus elastic fastening of the rail foot. However, the known fastening arrangement requires a screwing operation for elastically securing the rail in position, and this type of operation must be regarded as being undesirable.

SUMMARY OF THE INVENTION

It is an object of the present invention to provide a one-piece spring clip for elastic rail mounting for positively and elastically anchoring a rail relative to a tie plate without using any screws, said tie plate including fastening holes and the spring clip being adapted to be brought into engagement with said fastening holes in the area of its shank and consisting of a bent steel rod and being provided with a spring loop holding down the rail, said spring clip being adapted to be used also in combination with tie plates which do not have any spherical holding area.

It is another object of the present invention to further develop a spring clip of this type in such a way that, although the spring clip can be produced in a simple manner from a bent steel rod, the rail is held down in the area of its rail foot at two sections, the spring clip being, however, a single-shank spring clip.

Still another object of the present invention is to provide a spring clip of such a nature that it prevents tilting of the rail, although the rail has temporarily applied thereto an excessive load caused by an excessive horizontal force acting on the rail head.

Still another object of the present invention is to further develop a spring clip of the above-mentioned type in such a way that, in the case of conventional tilting moments, the rail foot is held down by elastic loops alone, whereas in the case of very high moments, i.e. so-called overload moments, tilting of the rail is prevented by an overload protection means, such moments occurring, for example, when rails and railway switches are aligned.

The present invention eliminates the problems and disadvantages of the prior art by providing a one-piece spring clip for elastic rail mounting for positively and elastically anchoring a rail relative to a tie plate without using any screws, said tie plate including fastening holes and the spring clip being adapted to be brought into engagement with said fastening holes in the area of its shank, said spring clip consisting of a cold-bent flat steel, said spring clip having two shanks, which are each followed by a spring loop defining a full circle of approximately 360° , each shank being defined by a straight steel rod member and having at its lower end at least one projection-type anchoring hook projecting above the cross-section of the shank and adapted to engage the tie plate underside, which faces away from the rail, in the area of the fastening hole and a connecting member being provided between the two spring loops, said connecting member having at least one area of contact, which rests on the rail foot for holding down the rail.

According to an important aspect of the invention, both shanks have at the upper end thereof a projection, which serves as an overload protection means and which is arranged at a small distance of approx. 1.5 mm above the surface of the rail foot in the inserted and tensioned condition of the spring clip.

In accordance with a further aspect of the invention, each shank is provided with two anchoring hooks and with two projections serving as an overload protection means, the distances between the overload protection means and the anchoring hooks being not identical on the two sides of the shank, and only one of the anchoring hooks of a shank engaging the underside of the tie plate in the area of the fastening hole, when the spring clip is inserted in said tie plate.

The present invention eliminates the problems and disadvantages of the prior art by providing a one-piece spring clip for elastic rail mounting for positively and elastically anchoring a rail relative to a tie plate without using any screws, said tie plate including fastening holes and the spring clip being adapted to be brought into engagement with said fastening holes in the area of its shank, said spring clip consisting of a bent steel rod and having a spring loop, which holds down the rail foot, said spring clip having at least one shank followed by a spring loop for holding down the rail foot, said shank being formed by a steel rod member bent by 180° and having, at its lower end in the area of the 180° -bend, a projection adapted to engage the tie plate underside, which faces away from the rail, in the area of the fastening hole.

According to an important aspect of the invention, the one-piece spring clip has two shanks, each of said shanks being followed by a spring loop for holding down the rail foot and said shanks being integrally connected by a connecting member.

In accordance with a further aspect of the invention, the connecting member is constructed as an overload protection means so as to prevent the rail from tilting in response to an occurrence of excessive tilting moments. In other words, the rail is prevented from tilting even in cases in which the tilting moments acting on the rail exceed the holding moments produced by the spring loops.

In accordance with still another aspect of the invention, the connecting member is defined by an offset part, which extends towards the rail and which, when attached to the tie plate, is in engagement with the rail foot so as to prevent the rail from tilting in response to an occurrence of excessive tilting moments, which exceed the holding moment produced by the spring loops.

According to a further aspect of the invention, the spring loops define circular arcs, which, extending from the shanks, are bent by approx. 170°.

In accordance with still another aspect, the shank is an expansion member and comprises two spring legs abutting on opposite walls of the fastening holes, when the spring clip is inserted in the tie plate.

According to a further aspect of the invention, the shank is provided with at least one projection engaging the underside of the tie plate in the area of the fastening hole, when the spring clip is inserted in the tie plate. When an additional projection is provided, fastening can be effected relative to fastening holes with different heights.

In accordance with another aspect of the invention, the steel rod, which is used for bending the spring clip, has a rectangular cross-section, and, consequently, it is particularly simple to produce.

According to still another aspect of the invention, the spring clip is constructed such that it has only one single shank, the two legs of said shank merging integrally with two spring loops for holding down the rail foot, said legs defining an acute angle when the spring clip is not tensioned.

Said angle lies preferably between 2° and 15°, and an angle of approx. 6° proved to be particularly advantageous.

According to still another aspect of the invention, the legs of said one-shank spring clip abut on each other at the lower end of the shank and extend away from each other in a configuration including an acute angle between said legs only from a bending point onwards, which is located after part of the length of the shank.

In the following, preferred embodiments of the present invention will be explained in detail while making reference to the drawings enclosed, in which FIG. 1 shows a side view of a first embodiment of the spring clip according to the invention with a sectional view through the tie plate in the direction of a rail, which is shown in a side view;

FIG. 2 shows a cross-sectional view of the rail of the tie plate and of the spring clip according to the invention in accordance with FIG. 1;

FIG. 3 .shows a top view of the rail, of the tie plate and of the spring clip according to FIG. 1 and FIG. 2;

Figure 1:
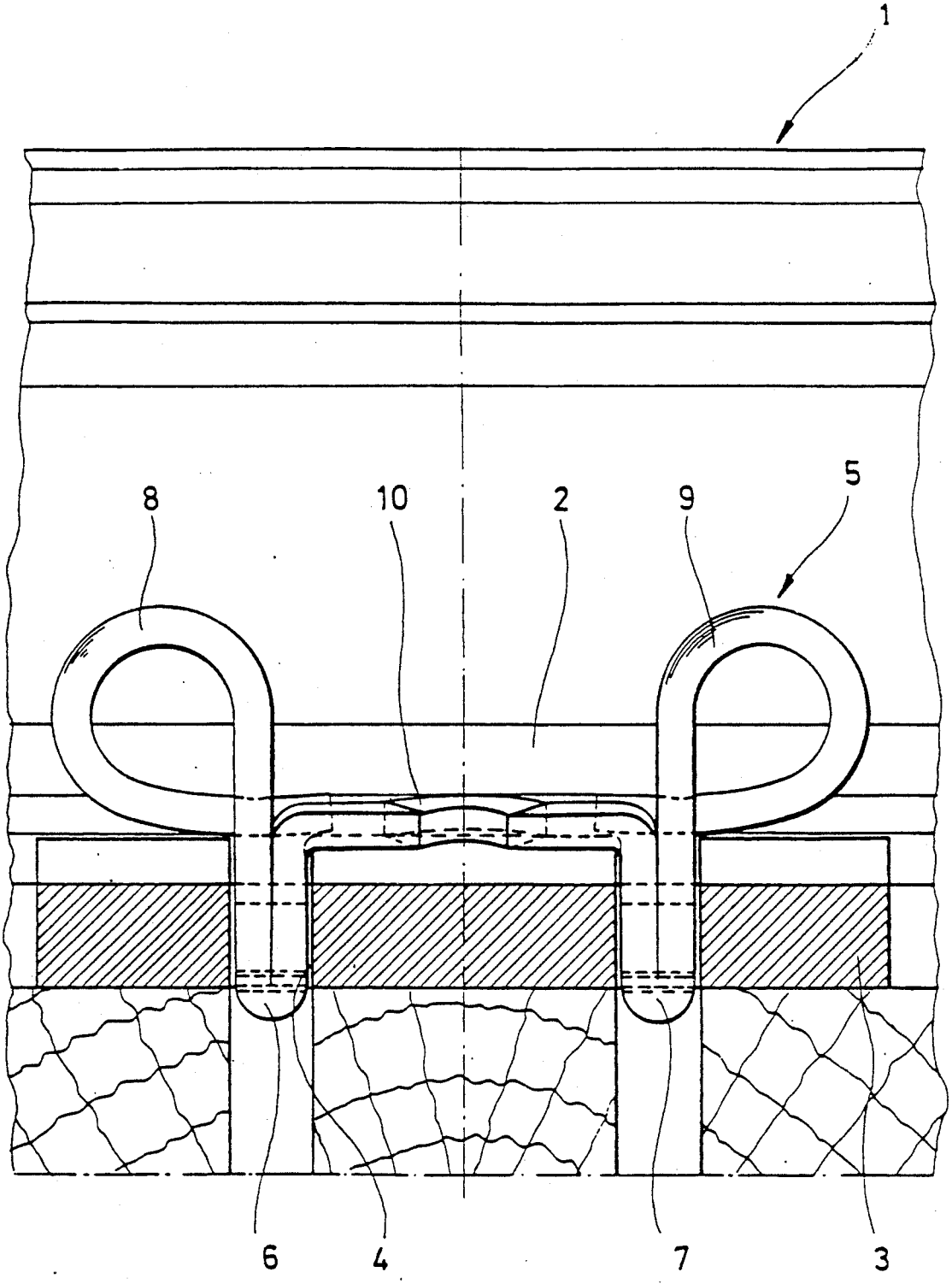

As can be seen in FIG. 1, a rail, which is provided with reference numeral 1 as a whole, rests with its rail foot 2 on a tie plate 3, which is, for example, a so-called "USA plate No. 8". The tie plate is provided with fastening holes 4, which are arranged in pairs on both sides of the rail foot 2. The first embodiment of a one-piece double-shank spring clip according to the invention, which is shown in FIG. 1 and which is, in turn, provided with reference numeral 5 as a-whole, is used for elastically and positively anchoring the rail 1 relative to the tie plate 3 without using any screws. This double-shank spring clip 5 is bent in one piece from a steel rod having an essentially rectangular cross-section. The double-shank spring clip 5 has two shanks 6, 7 followed by two spring loops 8, 9, which are formed integrally with said shanks and which are used for holding the rail foot down. Each shank 6, 7 is defined by a steel rod member bent by 180° .The spring loops 8, 9 are formed as three-quarter circular arcs, which extend from the shanks 6, 7 and define a circular arc of approximately 270° . The free ends of the spring loops 8, 9 rest on the rail foot 2 in a pretensioned condition.

The shanks 6, 7 merge integrally with a connecting member 10 providing the so-called overload protection.

Figure 3:
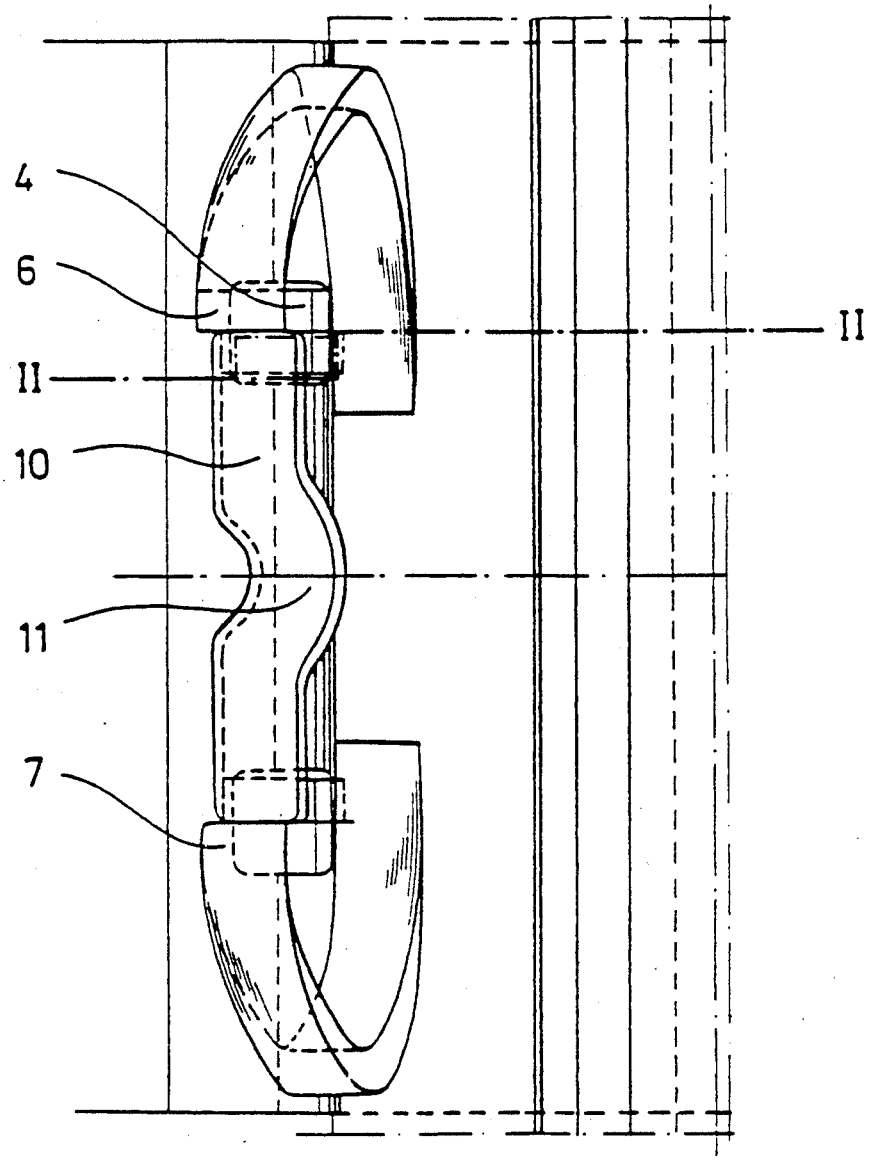

As can be seen especially from FIG. 3, the connecting member 10 serving as an overload protection is defined by an offset part 11, which extends towards the rail foot and which, when attached to the tie plate 3, is in engagement with said rail foot 2. The member 10, which serves as an overload protection, thus forms a protection means against tilting of the rail 1 in response to an occurrence of overload moments exceeding the holding down force produced by the spring loops 8, 9, which hold down the rail foot 2. If, in other words, the rail 1 is acted upon by an excessively high tilting moment, which exceeds the holding forces of the spring loops 8, 9, the connecting member 10 serving as an overload protection will prevent inadmissible further tilting of the rail 1, and a progressive spring characteristic will be obtained, consequently.

As is also clearly evident from FIG. 3, the steel rod, from which the double-shank spring clip is bent, has a rectangular cross-section. The fastening holes 4 through which the shanks 6, 7 extend are square holes in most cases. The plane referred to as cutting plane II—II in FIG. 3 is the plane corresponding to the representation according to FIG. 2.

Figure 2:
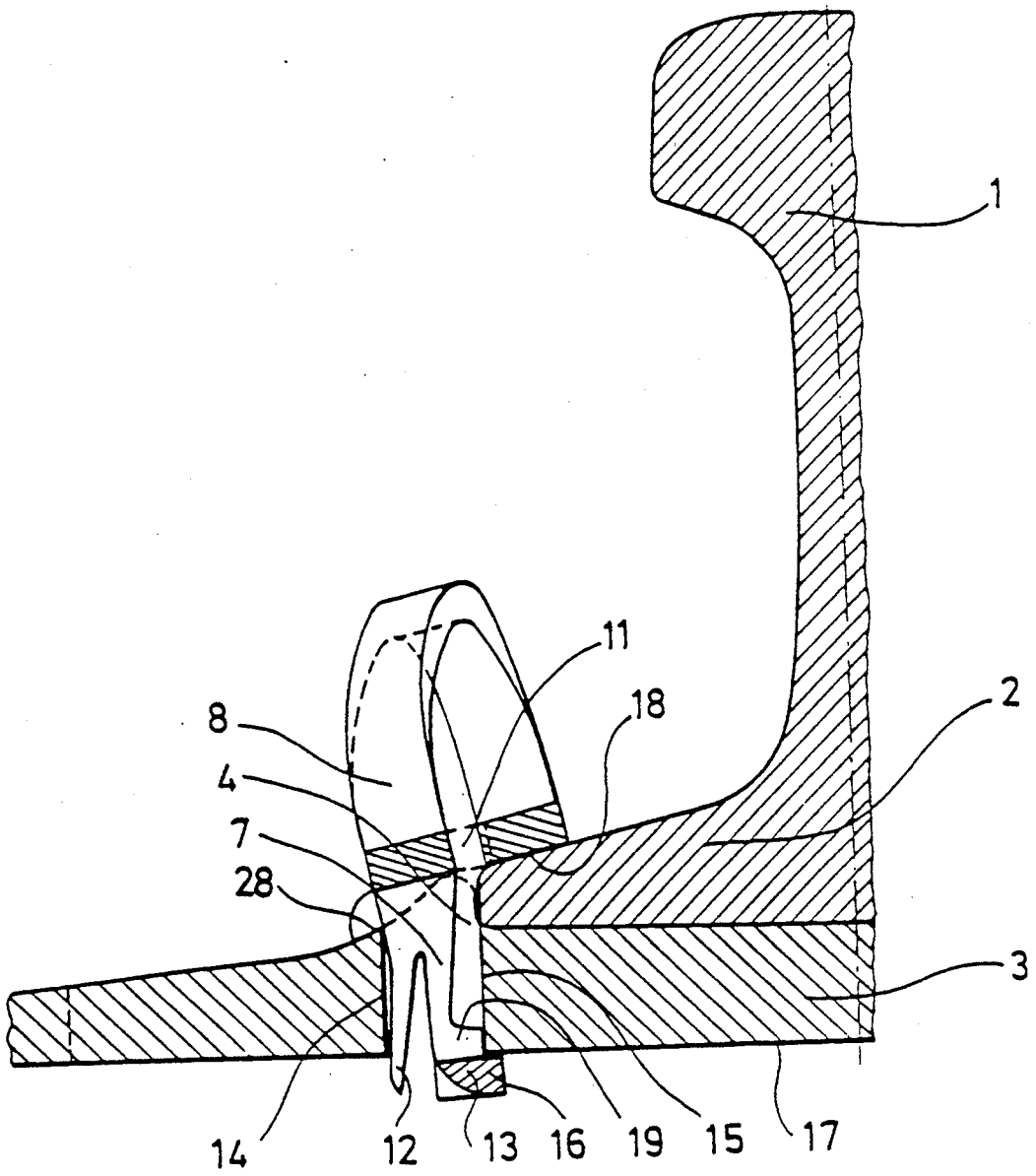

As can be seen from the cross-sectional representation according to FIG. 2, the shanks 6, 7 are expansion members and they are provided with two spring legs 12, 13 abutting on opposite walls 14, 15 of the fastening hole 4, when the spring clip 5 is attached to the tie plate 3. In this condition, a projection 16 is in engagement with the underside 17 of the tie plate 3. In view of the fact that the double-shank spring clip 5 is supported at the point of contact 28 when seen in relation to the edge of the wall of the fastening hole 4 and bears on the point of support 18 with a downwardly directed spring force when seen in relation to the rail foot 2, the resultant tilting moment guarantees that the projection 16 is pressed against the underside 17 of the tie plate 3.

The spring leg 12 additionally prevents the shank 6, 7 from slipping out of the tie plate area clasped by the projection 16. The shank 6, 7 can also be provided with several projections 16, 19 arranged in steps for permitting thus a locking engagement of the double-shank spring clip 5 in the case of inclined tie plates having fastening holes 4 of different heights. Preferably, two projections 16, 19 are provided. This represents an advantage in comparison with spring clips in the case of which the anchoring parts for the inner side and for the outer side have different anchoring claw heights, a circumstance which may cause confusions. A confusion will result in insufficient or excessive tensioning forces, whereby the necessary rail tensioning force can no longer be achieved or an excessive rail tensioning force is produced.

Figure 4:
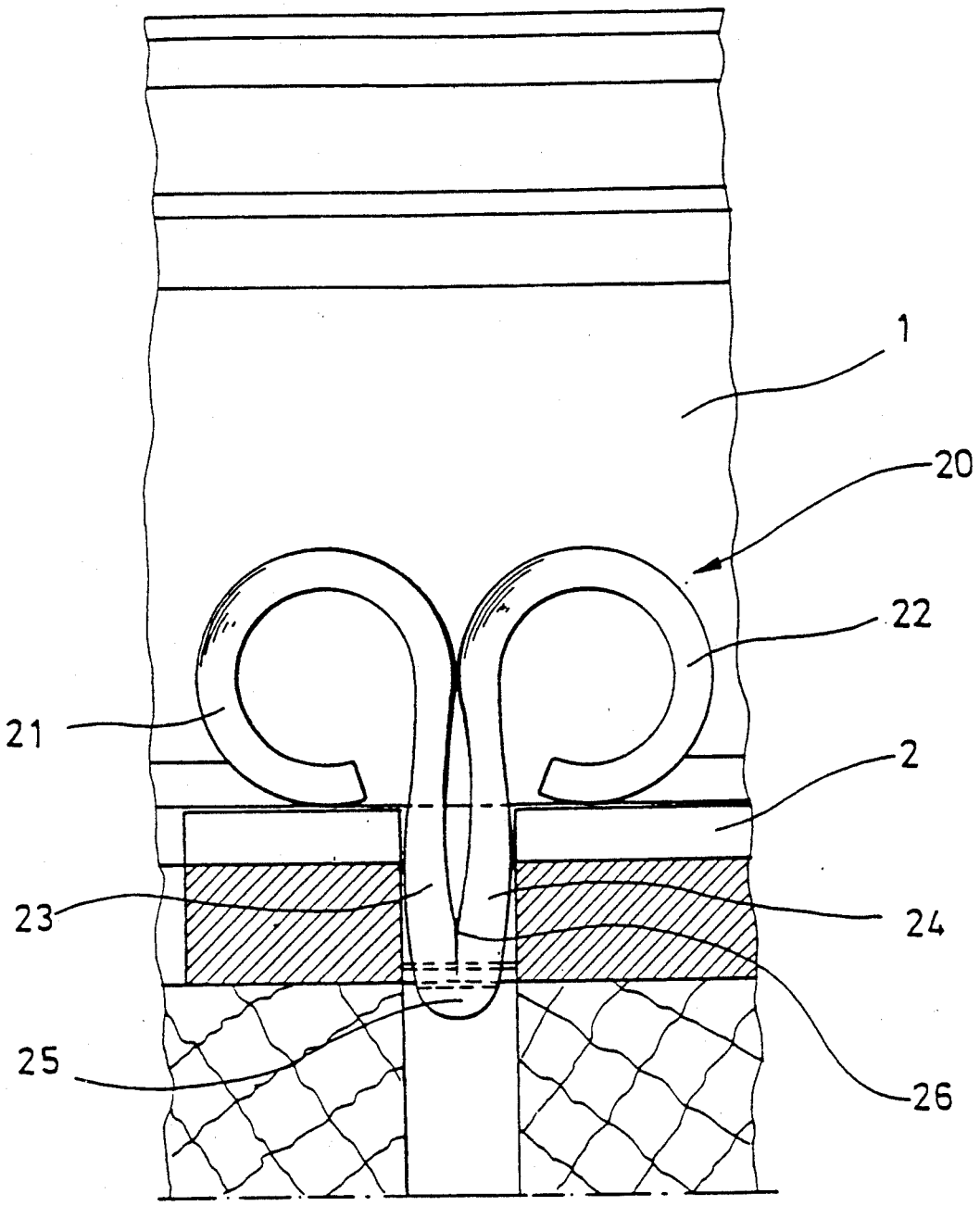
FIG. 4 shows a side view of a second embodiment of the spring clip according to the invention with a sectional view through the tie plate in the direction of a rail, which is shown in a side view.
Figure 5:
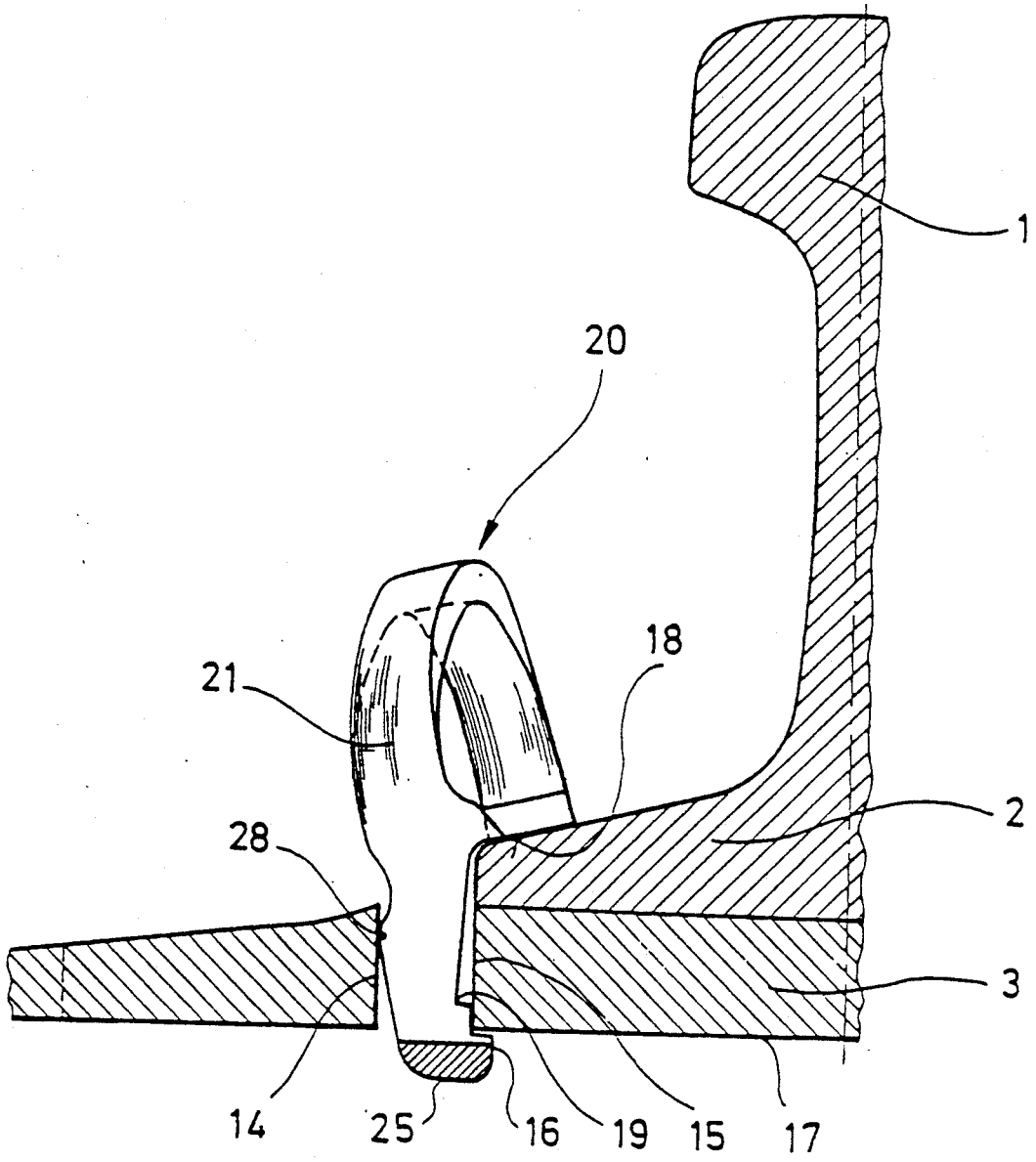
FIG. 5 shows a cross-sectional view of the rail, of the tie plate and of the spring clip according to FIG. 4.

Making reference to FIG. 4, an additional embodiment of the spring clip according to the invention is explained. Components corresponding to the components of the preceding embodiments are provided with identical reference numerals so that it is not necessary to explain these components again. Deviating from the embodiment of the spring clip according to the invention explained hereinbefore, the spring clip shown in FIG. 4 and 5 is constructed as a single-shank spring clip 20, which, however, consists of a bent steel rod as well. The spring clip comprises two spring loops 21, 22, which hold down the rail foot 2 and which merge with the shank 25 via legs 23, 24. As can especially be seen in FIG. 5, the lower end of the shank 25 is provided with two projections 16, 19 adapted to be brought into engagement with the tie plate 3.

As can especially be seen in FIG. 4, the legs 23, 24 abut on each other at the lower end of the shank 25 and, only from a bending point 26 onwards, which is located after part of the length of the shank 25, they extend away from each other in such a configuration that, when the spring clip is not tensioned, the legs 23, 24 include an angle between 2° and 15°, preferably an angle of 6°. In FIG. 4, the spring clip is shown in a pretensioned condition in the case of which the angle included by the legs 23, 24 is fully closed.

As can be seen from FIG. 5, the lower end of the shank 25 is constructed as a closed end in the case of the second embodiment of the single-shank spring clip. However, the possibility of constructing the lower end as an expansion-type part in the form of spring legs exists also in the case of this embodiment.

in the case of the above-mentioned embodiment, the side of the single-shank spring clip 20 facing away from the rail 1 is provided with a protrusion 28 of such a nature that said protrusion forms a defined line of contact on the wall 14 of the tie plate 3.

Figure 7:
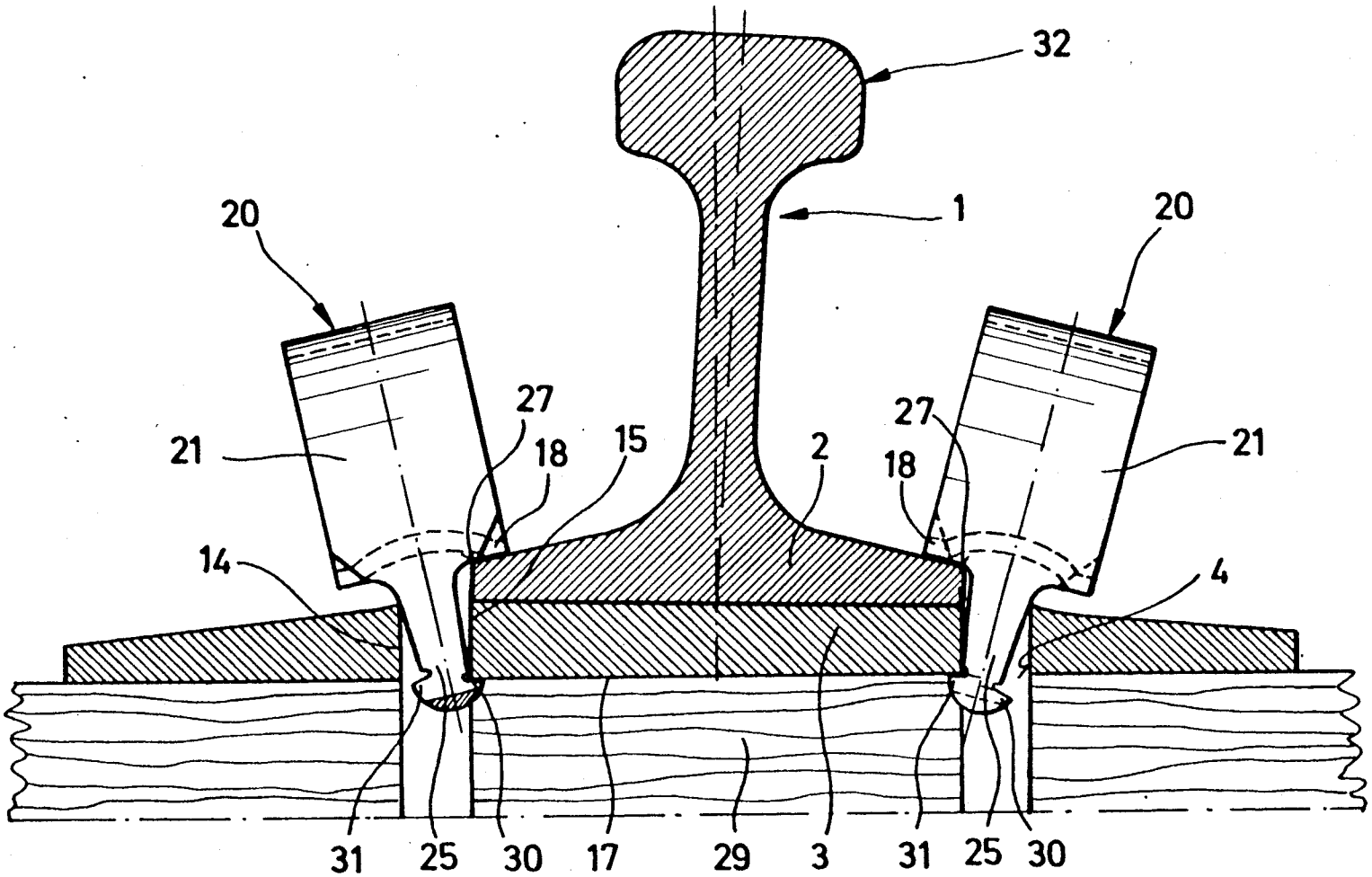
FIG. 7 shows a cross-sectional view of the rail, of the tie plate and of the additional form of the spring clip according to FIG. 6.

As can be seen most clearly from FIG. 7, the spring loop part following immediately the shank 25 is already broad enough for forming a cantilever arm 27, which serves as an overload protection. When occupying their normal position, the thus formed overload-protection cantilever arms 27 are located approx. 1.0 mm above the supporting surface on the rail foot so that they will come into engagement with the rail foot only if said rail foot is slightly tilted against the force exerted by the spring loops 21. In view of the fact that the overload-protection cantilever arms 27 are located directly at the end of the shank 25, the overload-protection means is comparatively rigid and, consequently, practically not elastic. For mounting the spring clip, the shank 25 is pressed into the square hole 4 until the overload-protection cantilever arms 27 come into contact with the rail foot 2. The spring clip is then tilted outwards, i.e. away from the rail 1, until the shank 25 abuts on the wall 14, the indented anchoring portion 30, 31 engaging simultaneously behind the underside of the tie plate 3 and penetrating thus also into the wood of the cross tie 29. This means that the anchoring hook 30 or 31 will then fulfill its function.

Figure 6:
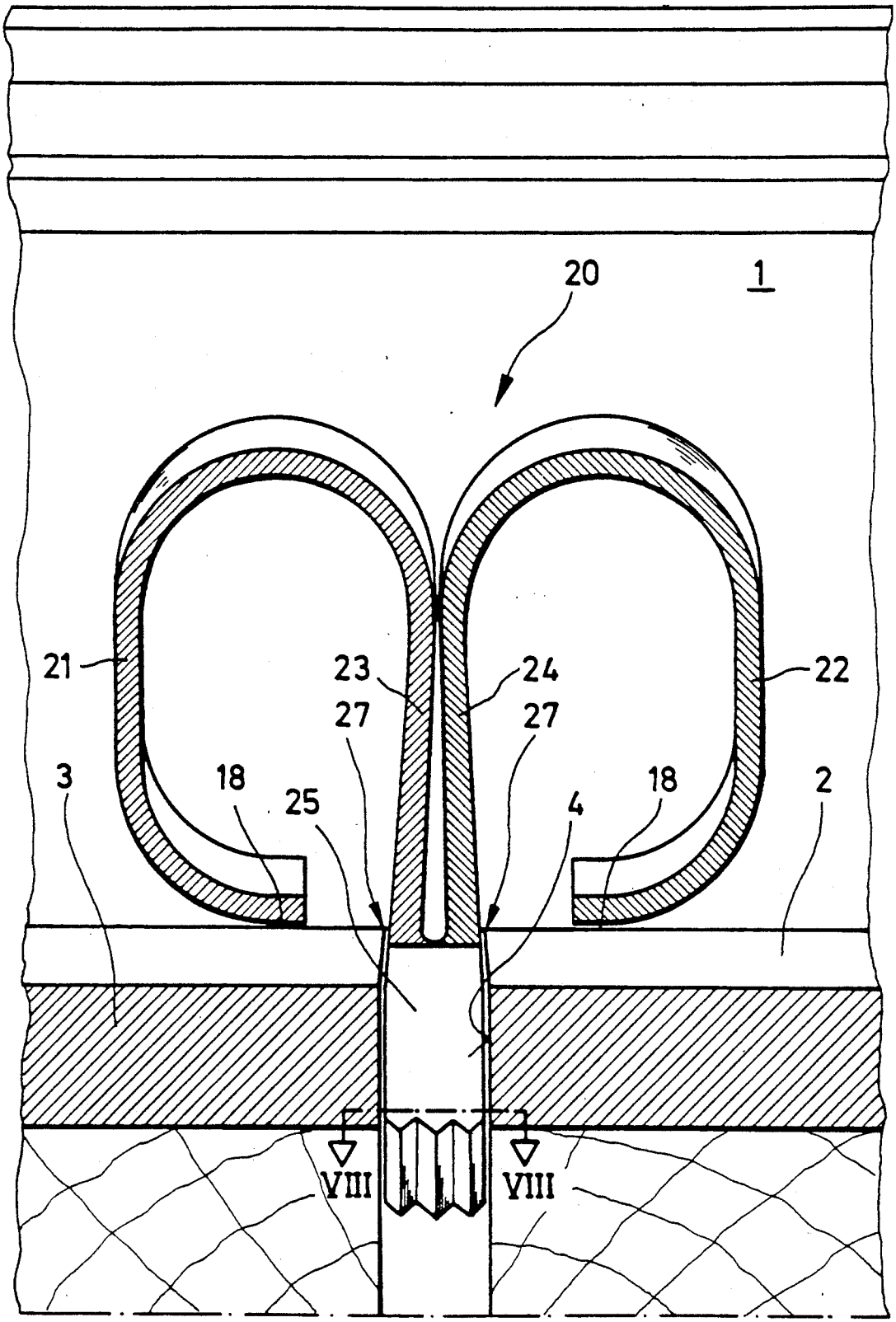
FIG. 6 shows a side view of a third form of the spring clip according to the invention in a sectional view through the tie plate in the direction of a rail, which is shown in a side view.
Figure 8:
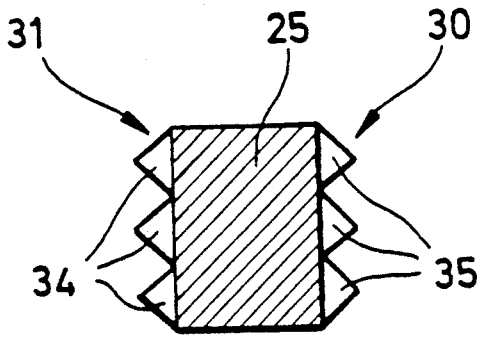
FIG. 8 shows a cross-section according to the section VIII—VIII in accordance with FIG. 6.

In the case of the embodiment of FIG. 6 to 8, the shank has at its lower end two oppositely disposed anchoring hooks 30 and 31, respectively, which are arranged at different distances from the overload-protection cantilever arms 27. This means that different tensioning lengths are obtained, a property which is advantageous with regard to wedge-shaped tie plates. In FIG. 7 such a wedge-shaped tie plate 3 is shown, in the case of which the side shown on the left is thicker than the side shown on the right.

As can especially be seen from FIG. 8 the anchoring hooks 30 and 31 are indented hooks and are provided with adequate outwardly directed pointed teeth 33 and 34, respectively, which penetrate more easily into the wood of the cross tie 29.

Making reference to FIG. 6, 7 and 8, an additional embodiment of the spring clip according to the invention will be explained.

The spring clip shown in FIG. 6, 7 and 8 differs from the spring clip of FIG. 4 and 5 essentially with regard to the fact that a special side of the higher tensioning spring clip is formed for each anchoring level or rather for tie plates 3 having different thicknesses. This is particularly advantageous with regard to inclined tie plates.

in the case of flat tie plates, the distances are identical.

Due to the use of a very broad, but not excessively thick flat steel, the tensioning force and the elastic spring excursion are substantially higher than in the case of comparable rail fastening elements. This has the effect that the pushing and the twisting resistance are essentially increased.

Due to a planar contact with the rail foot of $=1$ cm$^2$, damage will not be caused to the rail foot in spite of this high tensioning force.

FIG. 9 to 12 show an additional embodiment of the invention. This embodiment is a one-piece double-shank spring clip, which can be cold-punched from a flat steel having a cross-section of approx. $50\times5$ mm and which can, subsequently, be cold-bent. The special structural shape including big radii, which can be cold bent, fulfills the technical requirements such as a high tensioning force and sufficient spring excursion in combination with universal possibilities of use as well as the economic demands with regard to a minimal amount of production work.

Figure 9:
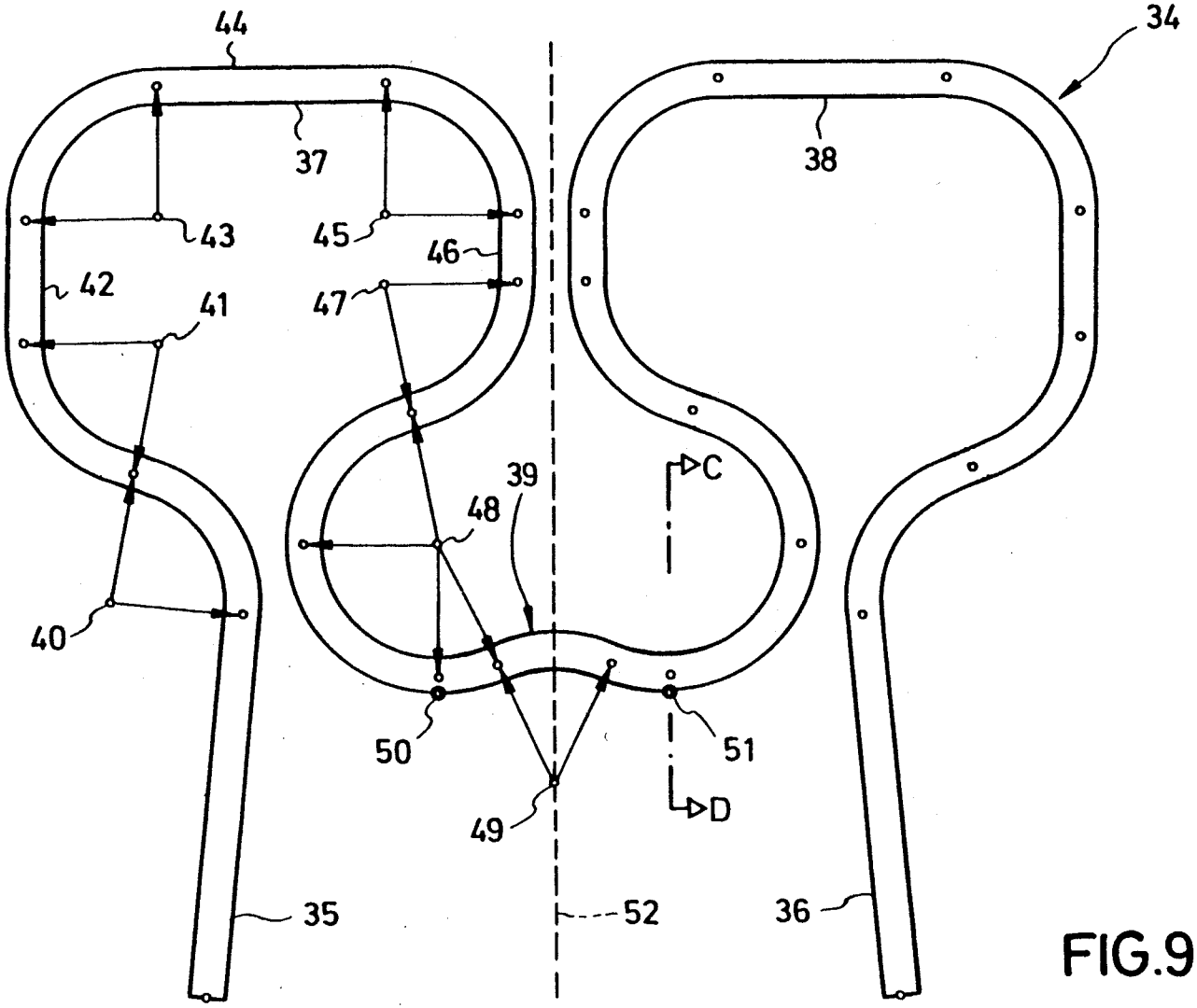
FIG. 9 shows a side view of a fourth embodiment of the spring clip according to the invention in the non-tensioned condition.

FIG. 9 shows a side view of a finished double-shank spring clip 34, which has, however, not yet been tensioned. This spring clip 34 is provided with two shanks 35 and 36 extending in a straight line in said side view. These shanks are each followed by a loop 37 and 38, which defines a full circle of 360° , said loops being integrally connected by a bent connecting member 39. Taking as a basis the side view of FIG. 9, the double-shank spring clip has the following shape:

The straight shank 35 is followed by a section, which is bent outwards with a first bending radius 40 and which merges with a subsection bent inwards with a second bending radius 41. The second bending radius 41 is followed by a straight section 42 extending essentially vertically, i.e. parallel to a plane of symmetry 52. This section 42 is followed by section, which is curved inwards with a third bending radius 43 and which ends in a straight section 44 extending horizontally, i.e. at right angles to the plane of symmetry 52. This section 44 is followed by a section, which is curved inwards with a fourth bending radius 45 and which ends in a section 46 extending vertically, i.e. parallel to said section 42. This section 46 is followed by a section bent inwards with a fifth bending radius 47. The section following then is a section, which is bent outwards with a sixth bending radius 48 and which defines the transition section between the loop 37 and the connecting member 39. The lowermost point of this bent section, the tangent of which extends perpendicularly to the plane of symmetry 52, defines a first point of support 50 where the spring clip rests on the rail foot. The following section is a section, which is bent with a seventh bending radius 49 and which defines the central portion of the connecting member 39. The centre of this portion intersects the-plane of symmetry 52. The second half of the spring clip is constructed symmetrically with regard to the plane of symmetry 52 in accordance with the half described hereinbefore. A second point of support 51 is then defined symmetrically to said first point of support 50. Accordingly, the loop 38 is symmetric to the loop 37 and the shank 36 is symmetric to the shank 35.

In the form of FIG. 9, which has not yet been tensioned, it is still possible to see that the two shanks 35 and 36 extend at an acute angle relative to the plane of symmetry 52. When the spring clip has been inserted and tensioned (FIG. 10), the shanks 35 and 36 will, however, extend parallel to the plane of symmetry.

Figure 10:
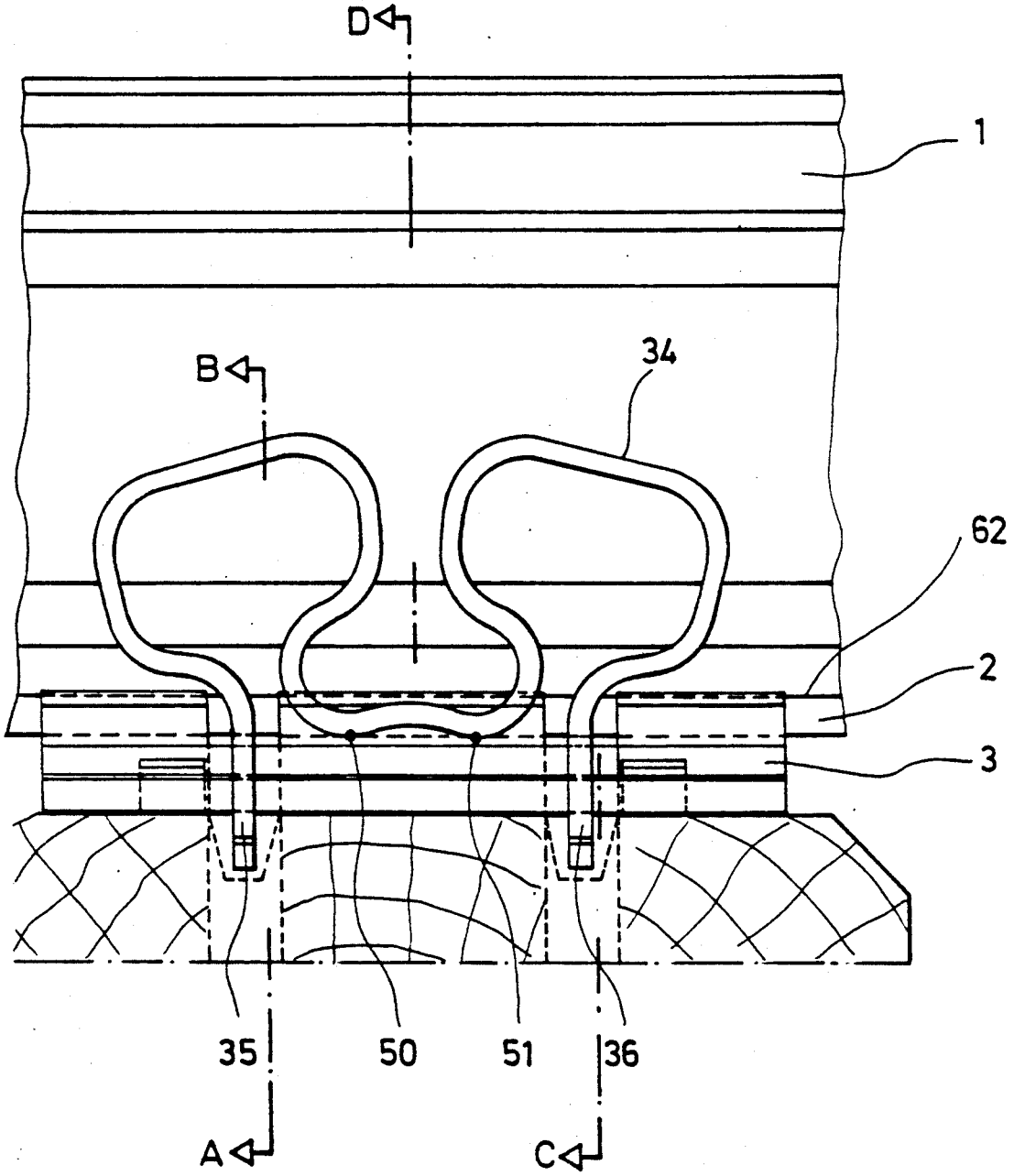
FIG. 10 shows a side view of the spring clip of FIG. 9 in the fully tensioned condition, only the front plane of projection of the "X" view of FIG. 11 being shown.

FIG. 10 shows the double-shank spring clip according to FIG. 9 in a tensioned condition, FIG. 9 representing only a view of the front plane of projection so that the tilting angle by which the centre line of the shank is tilted relative to the centre line of the rail (cf. FIG. 11) is not taken into account in this connection. Insofar FIG. 10 has to be regarded as a mere schematic representation. Accordingly, the points of support 50 and 51 rest in reality on the upper side 62 of the rail foot 2. The shanks 35 and 36 extend through the fastening holes 4 (FIG. 11) of the tie plate 3, which is, in turn, secured to a lumber tie 63. Due to the fact that the two shanks 35 and 36 are tensioned towards each other, the horizontal sections 44, which are arranged between the third and the fourth bending radius in FIG. 9, extend at an angle relative to the plane of symmetry.

Figure 11:
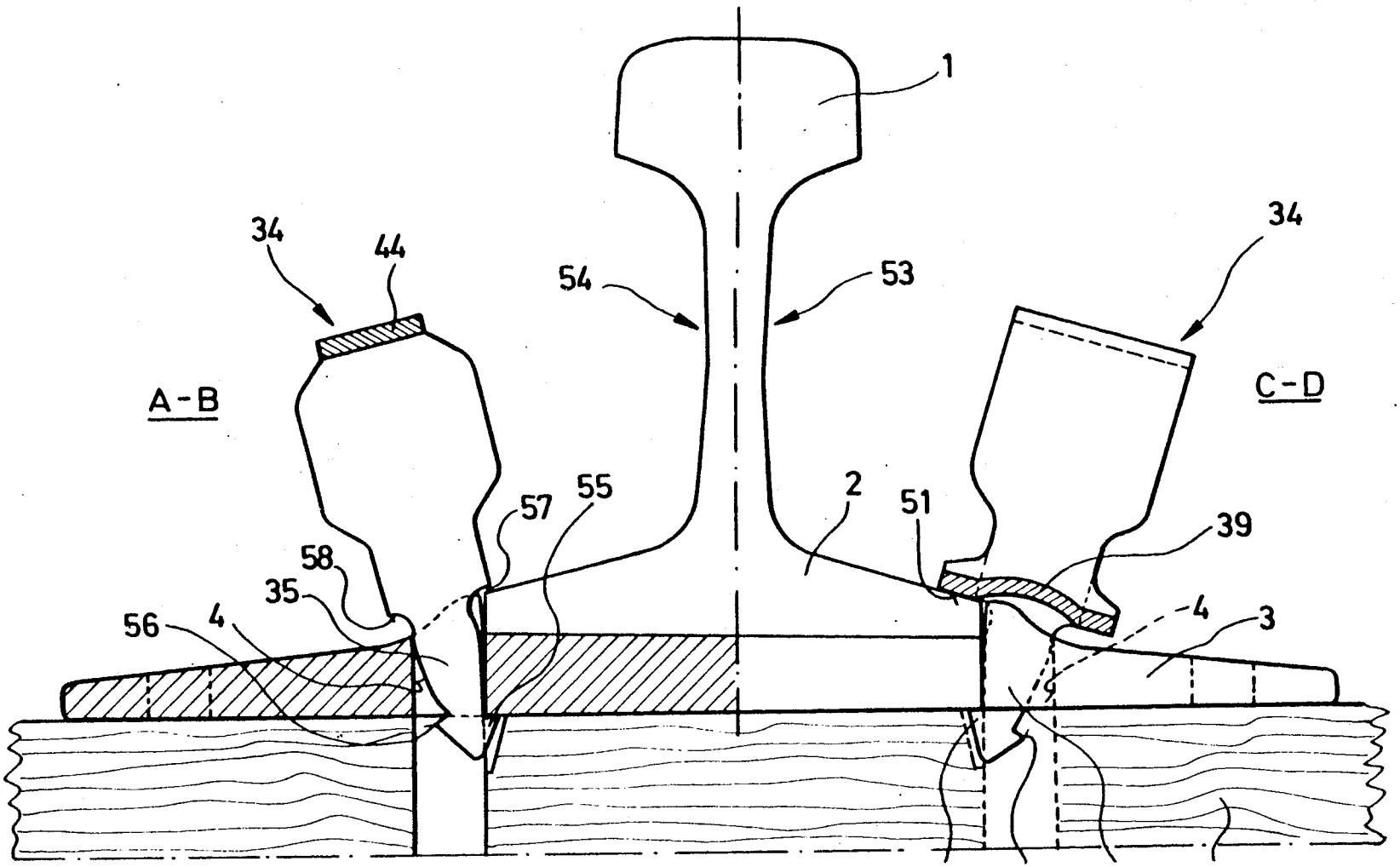
FIG. 11 shows a cross-sectional representation of a rail plus tie plate, which is tensioned on both sides by means of a spring clip according to the invention of the type shown in FIG. 9 and 10.
Figure 12:
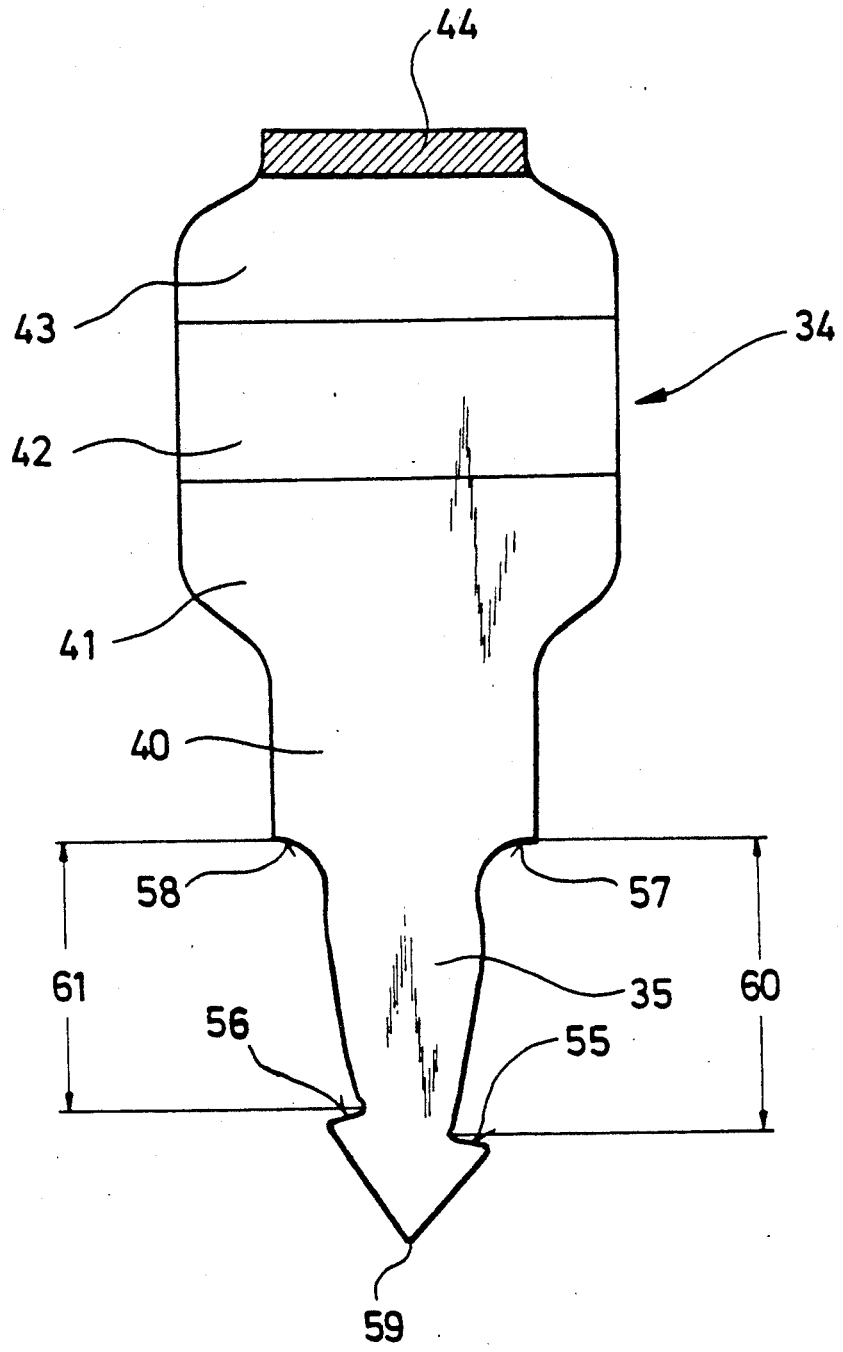
FIG. 12 shows a section along the line A-B for representing the shape of an anchoring shank.

FIG. 12 shows a section along the line A–B of FIG. 11 for illustrating the contour of the shank 35. The free end of the shaft 35 ends in a tip 59. At different distances 60, 61 from the overload protection means 57, 58, teeth 55 and 56 are formed, which - as can be seen from FIG. 11—engage below the tie plate 3. The reason for which these different distances 60 and 61 are provided is that one structural shape of the spring clip can thus be used more universally and can—as will be evident from FIG. 11—primarily be used on the inner side 53 and on the outer side 54 of a rail. In the case of most of the inclined rail plates, the thickness (tensioning level) is smaller on the inner side 53 than on the outer side 54. It follows that, on the inner side, the spring clip will be inserted such that the tooth 56 will be used, whereas on the outer side, where the plate is thicker, the tooth 55 will be used.

At a distance 60, 61 from the teeth 55 and 56, the shank widens so that edges and projections 57 and 58, respectively, which serve as an overload protection, are there formed on both sides. In the attached and tensioned condition of the spring clip, these edges extend at a small distance of e.g. 1.5 mm above the surface of the rail foot 2 so that only the points of support 50 and 51 (FIG. 9) tension the rail due to spring action. The rail can thus be elastically tilted against said spring action, and this will be useful in rail adjustment operations. This tilting is, however, limited by the overload protection means 57 and 58, respectively, for reasons of safety.

These overload protection means 57 and 58 are then followed by sections 40 to 44 according to FIG. 9.

in FIG. 11, the two double-shank spring clips used are shown in different cutting planes of FIG. 10. The spring clip attached to the outer side 54 is cut along the cutting line A–B of FIG. 10, whereas the spring clip used on the inner side 53 is cut along the line C–D of FIG. 10. From this it is also evident that the central portion 39 is additionally curved upwards and that the areas 50 and 51, respectively, which rest on the rail foot, are of a planar nature in this cutting plane so that support surfaces having a size of approx. 1 $cm^2$ *are available.*

In the case of the spring clip which is shown in FIG. 11 and which is attached to the outer side 54, it is also possible to see the distance between the overload protection means 57 and the upper side of the rail foot. FIG. 11 as a whole also shows that inclined tie plates 3 can be used due to the different distances between the tooth 55 and the overload protection means 57 and between the tooth 56 and the overload protection means 58.

Figure 13:
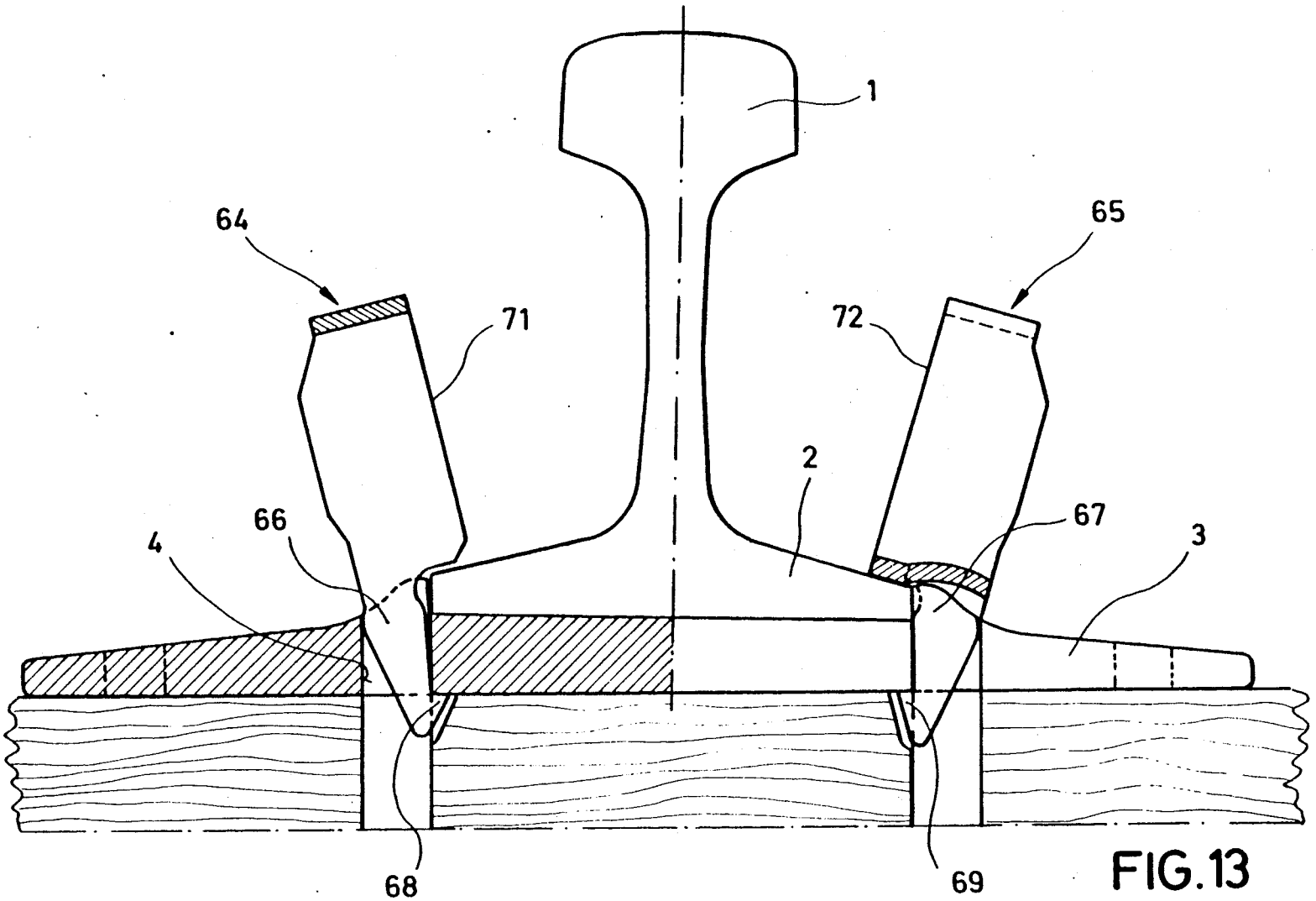
FIG. 13 shows a cross-sectional representation of a rail plus tie plate as well as a cross-sectional representation of a fifth embodiment of the spring clip according to the invention, which is used for the outer side of the rail, and of a sixth embodiment of the spring clip according to the invention, which is used for the inner side of the rail.

As can be seen from FIG. 13, the fifth and sixth embodiments of the double-shank spring clip according to the invention, which are shown in said FIG. 13 and which are respectively provided with reference numerals 64 and 65, essentially differ from the fourth embodiment of the double-shank spring clip 34 according to FIG. 9 to 12 with regard to the fact that, for the purpose of positively anchoring the rail foot 2 relative to the tie plate 3, two non-identical double-shank spring clips 64, 65 are now used for the outer side and for the inner side of the rail 1, the shanks of said spring clips being only provided with a single tooth 68, 69 or anchoring hook 68, 69.

The fifth embodiment of the spring clip 64 according to the invention, which is used for the outer side of the rail, differs from the sixth embodiment of the double-shank spring clip 65, which is used for the inner side of the rail, in so far as the shank 66 of the fifth embodiment of the double-shank spring clip 64 provided on the outer side is longer than the shank 67 of the sixth embodiment of the double-shank spring clip 65 provided on the inner side.

Figure 14:
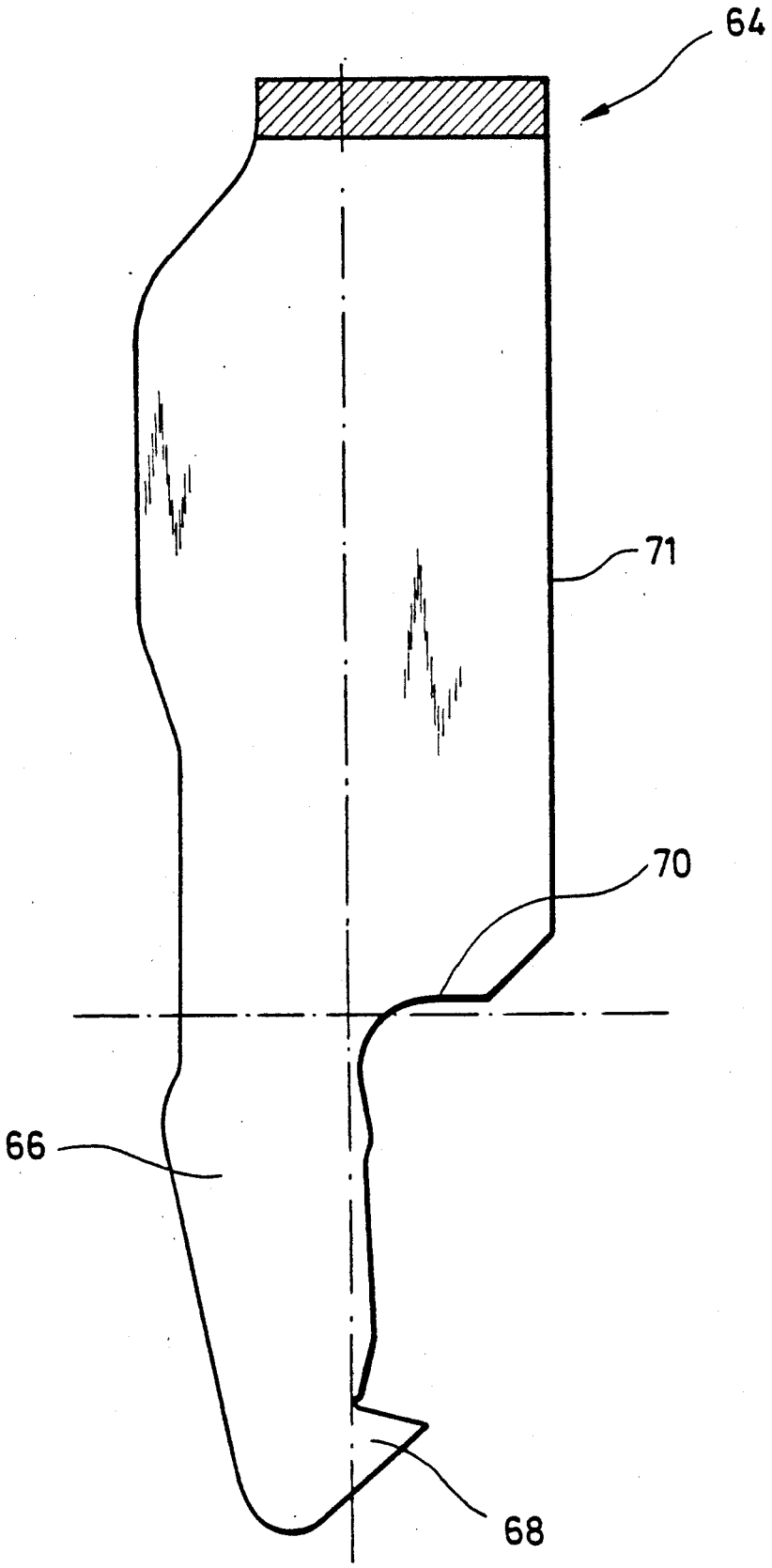
FIG. 14 shows an enlarged representation of the cross-sectional contour of the fifth embodiment of the spring clip according to the invention in accordance with FIG. 13.

As can especially be seen from the enlarged representation of the fifth embodiment of the double-shank spring clip 64 according to FIG. 14, also this embodiment of the double-shank spring clip 64 according to the invention is provided with an overload protection means 70, which is arranged at a small distance from the upper side of the rail foot 2 in the condition in which the spring clip is tensioned and engages the tie plate 3. An appropriate distance between the overload protection means and the rail foot would have a magnitude of approx. 1.5 mm. In any case, it is guaranteed that the overload protection means 70 does not contact the rail foot 2 in the non-tilted condition of said rail foot 2.

Figure 15:
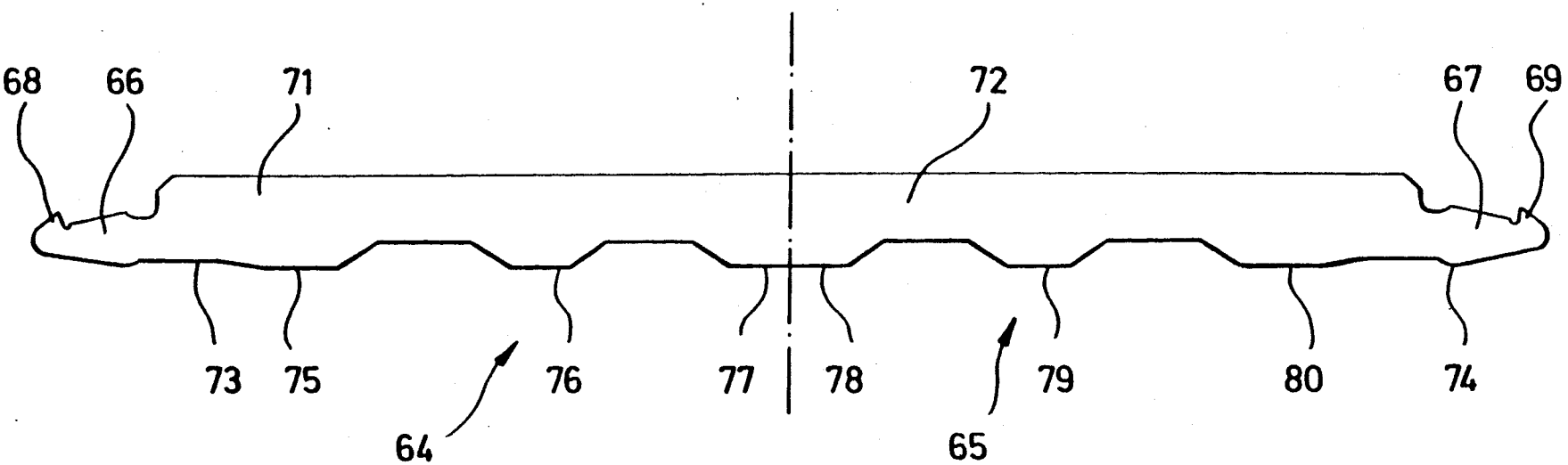
FIG. 15 shows a top view of the developed view of the spring clip according to the invention, the left half of he representation according to FIG. 15 showing half the developed view of the fifth embodiment and the right half of the representation according to FIG. 15 showing half the developed view of the sixth embodiment of the spring clip according to the invention.

As can be seen from FIG. 14 and 15, a characteristic feature of the fifth and of the sixth embodiments of the spring clip 64, 65 according to the invention—when compared with the first and the fourth embodiment—is that their lateral surface 71, 72, which faces the rail 1, is straight, whereas recessed areas 75, 76, 77 and 78, 79, 80, respectively, are only provided in the lateral surface 73, 74, which defines part of the fifth and of the sixth embodiment of the spring clip 64, 65 and which faces away from the rail, said recessed areas being arranged only at the locations at which the fully bent and inserted spring clip will have applied thereto the maximum bending moments. These recessed areas have the effect that the tension is uniformly distributed over the whole length of the spring clip 64, 65 and that, consequently, the maximum obtainable optimum spring excursion is achieved.

With regard to the last-mentioned aspect, viz. that the contours of the double-shank spring clip 64, 65 according to the fifth and the sixth embodiment are of-such a nature that they include a straight lateral surface 71, 72 and a lateral surface 73, 74 provided with recessed areas 75, 76, 77; 78, 79, 80 the fifth and the sixth embodiment differ from the first and the fourth embodiment according to FIG. 8 to 12, which are adapted to be used for fastening the rail on its outer side as well as for fastening the rail on its inner side and which are, consequently, equipped with recessed areas on both sides. In comparison with the embodiments according to FIG. 1 to 12, the fifth and the sixth embodiment according to FIG. 13 to 15 have been optimized with regard to the use of material, since material for the recessed areas 75 to 80 is only used at points at which mechanical stresses necessitate such use.

An essential aspect of all the embodiments of the invention also resides in their manufacturing process. In the case of the fifth or sixth embodiment, for example, the contour or shape of the spring clIp accordIng to FIG. 15 is first determined by punching. If the punching forces should prove to be excessively high for a conventional punching tool, the punching operation can be carried out by means of an angle-cutting tool, which does not simultaneously contact the spring clip to be punched with its full cutting surface, but which progressively engages the spring clip upon being progressively advanced in the direction of punching. An essential aspect in this connection is that the punching is carried out in a cold state of the steel, the expression cold state being in this connection interpreted such that it also includes a certain amount of preheating up to a temperature value of 500 degrees centigrade at the most. Such preheating can, for example, be carried out by means of an induction coil (not shown).

After punching of the spring clip, said spring clip is subjected to cold bending so as to obtain the shape which can be seen from FIG. 9 for the fourth embodiment of the spring clip. Subsequently, the clip is subjected to a tempering treatment so as to provide the spring steel with the necessary springiness.

We claim:

1. A one-piece spring clip for positively and elastically anchoring a rail relative to a tie plate without using any screws, said tie plate including fastening holes, the spring clip being made of bent flat steel, the spring clip including two shanks for engaging the fastening holes, each shank being followed by a spring loop defining a full circle of approx. 360°, each shank being defined by a straight rod member and including at a lower end thereof, at least one projection-type anchoring hook projecting above the cross-section of the shank and adapted to engage the tie plate underside, which faces away from the rail, in the area of the fastening hole, the spring clip including a connecting member between the two spring loops, said connecting member including at least one area of contact, which rests on the rail foot for holding down the rail, and each shank including at an upper end thereof a projection, which serves as an overload protection means and which is arranged at a distance of approximately 1.5 mm above the surface of the rail foot in an inserted and tensioned condition of the spring clip.

2. A one-piece spring clip for positively and elastically anchoring a rail relative to a tie plate without using any screws, said tie plate including fastening holes, the spring clip being made of bent flat steel, the spring clip including two shanks for engaging the fastening holes, each shank being followed by a spring loop defining a full circle of approximately 360°, each shank being defined by a straight rod member and including at a lower end thereof, a first projection-type anchoring hook projecting above the cross-section of the shank and adapted to engage the tie plate underside, which faces away from the rail, in the area of the fastening hole, the spring clip including a connecting member between the two spring loops, said connecting member including at least one area of contact, which rests on the rail foot for holding down the rail, each shank including at an upper end thereof, a first projection which serves as an overload protection means and which is arranged at a distance of approximately 1.5 mm above the surface of the rail foot in an inserted and tensioned condition of the spring clip, and each shank including a second anchoring hook similar to the first anchoring hook on an opposite side of the shank and a second projection serving as an overload protection means similar to the first projection on an opposite side of the shank, the distance between the first overload protection means and the first anchoring hook being not identical to the distance between the second overload projection means and the second anchoring hook and wherein only one of the anchoring hooks of a shank engages the underside of the tie plate in the area of the fastening hole, when the spring clip is inserted in said tie plate.

3. A one-piece spring clip for positively and elastically anchoring a rail relative to a tie plate without using any screws, said tie plate including fastening holes, the spring clip being made of a bent steel rod, the spring clip including two shanks for engaging the fastening holes and a spring loop holding down the rail foot associated with each of said shanks, each of said shanks being bent by 180° to form two legs and including, at a lower end thereof in the area of the 180° bend, at least one projection-type anchoring hook projecting above the cross-section of the shank and adapted to engage to a tie plate underside, which faces away from the rail, in the area of the fastening hole, the spring clip including connecting member integrally connecting said shanks, the connecting member including an overload protection means comprising an offset part, which extends towards the rail and which, when attached to the tie plate, is in engagement with the rail foot so as to prevent the rail from tilting in response to an occurrence of excessive tilting moments which exceed the holding moment produced by the spring loops.

4. A spring clip according to claim 3, wherein the spring loops define circular arcs, which are bent by approximately 170° from the shanks.

5. A spring clip according to claim 3, wherein each of said shanks is an expansion member and comprises two spring legs abutting on opposite walls of the fastening holes, when the spring clip is inserted in the tie plate.

6. A spring clip according to claim 3, wherein the steel rod has a rectangular cross-section.

7. A spring clip according to claim 6, wherein the rectangular cross-section is approximately 50×5 mm.

8. A one-piece spring clip for positively and elastically anchoring a rail relative to a tie plate without using any screws, said tie plate including fastening holes, the spring clip being made of a bent steel rod, the spring clip including a shank for engaging one of the fastening holes, the shank being bent by 180° to form two legs and including, at a lower end thereof in the area of the 180° bend, at least one projection-type anchoring hook projecting above the cross-section of the shank and adapted to engage a tie plate underside, which faces away from the rail, in the area of the fastening hole, and the spring clip including two spring loops, the two legs of said shank merging integrally with the two spring loops for anchoring the rail foot, the anchoring portion having two oppositely disposed anchoring hooks arranged at different distances from an end of the shank for inclined tie plates.

9. A spring clip according to claim 8, wherein the spring loops define circular arcs, which are bent by approximately 170° from the shanks.

10. A spring clip according to claim 8, wherein the shank is an expansion member and comprises two spring legs which abut on opposite walls of the fastening holes when the spring clip is inserted in the tie plate.

11. A spring clip according to claim 8, wherein the steel rod has a rectangular cross-section.

12. A spring clip according to claim 11. wherein the rectangular cross-section is approximately 50×5 mm.

13. A spring clip according to claim 8, wherein said legs of said shank define an acute angle when the spring clip is not tensioned.

14. A spring clip according to claim 13, wherein said angle is between 2° and 15°.

15. A spring clip according to claim 14, wherein said angle is approximately 6°.

16. A spring clip according to claim 8, wherein the legs are connected to each other at the lower end of the shank and portions of the legs extend away from each other at an acute angle.

17. A one-piece spring clip for positively and elastically anchoring a rail relative to a tie plate without using any screws, said tie plate including fastening holes, the spring clip being made of a bent steel rod, the spring clip including a shank for engaging one of the fastening holes, the shank being bent by 180° to form two legs and including, at a lower end thereof in the area of the 180° bend, at least one projection-type anchoring hook projecting above a cross-section of the shank and adapted to engage the tie plate underside, which faces away from the rail, in the area of the fastening hole, the spring clip including two spring loops, the two legs of said shank merging integrally with the two spring loops for holding down the rail foot, the spring clip further including two oppositely disposed anchoring hooks arranged at different distances from the end of the shank for inclined tie plates, and the shank being forged so as to obtain a cross-section of one of 18×18 mm and a cross-section corresponding to a shape of the fastening holes.

18. A spring clip according to claim 17, wherein the spring loops define circular arcs, which are bent by approximately 170° from the shanks.

19. A spring clip according to claim 17, wherein the shank is an expansion member and comprises two spring legs which abut on opposite walls of the fastening holes when the spring clip is inserted in the tie plate.

20. A spring clip according to claim 17, wherein the steel rod has a rectangular cross-section.

21. A spring clip according to claim 20, wherein the rectangular cross-section is approximately 50×5 mm.

22. A spring clip according to claim 17, wherein said legs of said shank define an acute angle when the spring clip is not tensioned.

23. A spring clip according to claim 22, wherein said angle is between 2° and 15°.

24. A spring clip according to claim 23, wherein said angle is approximately 6°.

25. A spring clip according to claim 17, wherein the legs are connected to each other at a lower end of the shank and portions of the legs extend away from each other at an acute angle.

26. A one-piece spring clip for positively and elastically anchoring a rail relative to a tie plate without using any screws, said tie plate including fastening holes, the spring clip being made of a bent steel rod, the spring clip including a shank for engaging one of the fastening holes, the shank being bent by 180° to form two legs and including, at a lower end thereof in the area of the 180° bend, two oppositely disposed projection-type anchoring hooks projecting above the cross-section of the shank and adapted to engage to tie plate underside, which faces away from the rail, in the area of the fastening hole, the two anchoring hooks arranged at different distances from the end of the shank for inclined tie plates, the spring clip including two spring loops, the two legs of said shank merging integrally with the two spring loops for holding down the rail foot, and a portion of the hook for engaging the cross tie comprising, in the direction of the cross tie, at least two wedge-shaped teeth so that said hook portion can penetrate into the cross tie and produce a better anchoring effect.

27. A spring clip according to claim 26, wherein the spring loops define circular arcs, which are bent by approximately 170° from the shanks.

28. A spring clip according to claim 26, wherein the shank is an expansion member and comprises two spring which legs abut on opposite walls of the fastening holes when the spring clip is inserted int he tie plate.

29. A spring clip according to claim 26, wherein the steel rod has a rectangular cross-section.

30. A spring clip according to claim 29, wherein the rectangular cross-section is approximately 50×5 mm.

31. A spring clip according to claim 26, wherein said legs of said shank define an acute angle when the spring clip is not tensioned.

32. A spring clip according to claim 31, wherein said angle is between 2° and 15°.

33. A spring clip according to claim 32, wherein said angle is approximately 6°.

34. A spring clip according to claim 26, wherein the legs are connected to each other at the lower end of the shank and portions of the legs extend away from each other at an acute angle.

35. A one-piece spring clip for positively and elastically anchoring a rail relative to a tie plate without using any screws, said tie plate including fastening holes, the spring clip being made of a bent flat steel, the spring clip including two shanks for engaging the fastening holes, each shank being defined by a straight steel rod member and including at a lower end thereof, at least one projection-type anchoring hook projecting above the cross-section of the shank and adapted to engage a tie plate underside, which faces away from the rail, in the area of the fastening hole, said spring clip including two spring loops, each connected to one of said shanks and defining a generally full circle and having a first bending direction, and including a connecting member connected between the spring loops, said connecting member having two areas of contact, which rest on the rail foot for holding down the rail, said connecting member comprising a first connecting section and a second connecting section, each of said first and second connecting section extending from one of said spring loops and a third connecting section connecting said first and second connecting sections and having a curvature in an opposing direction to a curvature of each of the first and second connecting section.

36. A spring clip according to claim 35, wherein:

each shank is followed by a first loop section, which is bent outwards with a first bending radius and which merges with a second loop section bent inwards with a second bending radius, the second loop section is followed by a straight third loop section, the third loop section is followed by a fourth loop section which is curved inwards with a third bending radius and which ends in a straight fifth loop section extending horizontally, the fifth loop section is followed by a sixth loop section, which is curved inwards with a fourth bending radius and which ends in a seventh loop section extending vertically, parallel to said third loop section, the seventh loop section is followed by an eighth loop section bent inwards with a fifth bending radius, the eighth loop section is followed by a transition section disposed between the spring loop and the connecting member, which is bent outwards with a sixth bending radius, and a lowermost point of the transition section, a tangent of which extends perpendicularly to a plane of symmetry of the spring clip, defining one of the areas of contact, the plane of symmetry intersecting the third connecting section.

* * * * *